United States Patent [19]

Maas et al.

[11] Patent Number: 4,991,778

[45] Date of Patent: Feb. 12, 1991

[54] ADJUSTABLE NOZZLE ASSEMBLY

[75] Inventors: Wilhelmus J. J. Maas, Someren; Petrus L. W. Hurkmans, Someren-Eind, both of Netherlands

[73] Assignee: AFA Products, Inc., Forest City, N.C.

[21] Appl. No.: 437,549

[22] Filed: Nov. 16, 1989

[51] Int. Cl.[5] ..... B05B 9/043; B05B 1/12

[52] U.S. Cl. ..... 239/333; 239/483; 239/489; 239/496; 239/497; 239/539

[58] Field of Search ..... 239/333, 476, 477, 478, 239/479, 482, 483, 489, 493, 494, 496, 497, 539

[56] References Cited

U.S. PATENT DOCUMENTS

| | | | |
|---|---|---|---|
| 1,166,340 | 12/1915 | Erickson | 112/80.5 |
| 1,620,209 | 3/1927 | Ihne | 239/497 |
| 1,631,894 | 6/1927 | Schlaepfer | 239/481 |
| 2,378,348 | 6/1945 | Wiles et al., | 239/491 |
| 2,577,901 | 12/1951 | Marlow | 239/491 |
| 3,061,202 | 10/1962 | Tyler | 239/333 |
| 3,120,348 | 2/1964 | O'Donnell | 239/490 |
| 3,843,030 | 10/1974 | Micallef | 222/554 |
| 4,109,869 | 8/1978 | Brockelsby et al. | 239/333 |
| 4,234,128 | 11/1980 | Quinn et al. | 239/478 |
| 4,247,048 | 1/1981 | Hayes | 239/396 |
| 4,313,568 | 2/1982 | Shay | 239/333 |
| 4,350,298 | 9/1982 | Tada | 239/333 |
| 4,503,998 | 3/1985 | Martin | 222/341 |
| 4,669,664 | 6/1987 | Garneau | 239/333 |
| 4,678,123 | 7/1987 | Klaeger | 239/464 |
| 4,706,888 | 11/1987 | Dobbs | 239/478 |
| 4,730,775 | 3/1988 | Maas | 239/120 |
| 4,767,060 | 8/1988 | Shay et al. | 239/417 |
| 4,768,717 | 9/1988 | Shay | 239/403 |
| 4,779,803 | 10/1988 | Corsette | 239/428.5 |

*Primary Examiner*—Andres Kashnikow
*Assistant Examiner*—Karen B. Merritt
*Attorney, Agent, or Firm*—Thomas R. Vigil

[57] ABSTRACT

The adjustable nozzle assembly for a trigger sprayer comprises a nose bushing and an integral nozzle cap capable of being screwed upon the bushing. The nozzle cap has a discharge orifice located in its front face and a flange skirt extending from a front wall thereof. A nozzle cap flange skirt is threaded inside the rear portion thereof and an internally contoured or stepped surface is located forwardly of the threads to provide reduced diameter annular surfaces at two locations rearward of an inner wall surface of the cap and forward of the internal threads inside the nozzle cap flange skirt. The nozzle cap is screwed upon (threaded on) an externally threaded portion of the nose bushing and is selectively threadably positionable between three selective positions such that the positioning of the inner wall surface and the annular surfaces of the nozzle cap flange skirt selectively cooperate with a front face and annular periphery of a nose bushing face disc having two angular grooves in the annular periphery thereof thereby selectively to provide a stop mode position for containment of liquid, a spray mode position to discharge liquid in a spray pattern from the discharge orifice, and a stream mode position to discharge liquid in a stream pattern from the discharge orifice.

14 Claims, 6 Drawing Sheets

ADJUSTABLE NOZZLE ASSEMBLY

BACKGROUND OF THE INVENTION

1. Field of the Invention

The present invention relates to an adjustable nozzle assembly for mounting to a trigger sprayer which is used in dispensing liquids and more particularly to an assembly for dispensing liquid in a spray or jet mode and for containing the liquid in an off mode.

2. Description of the Related Art Including Information Disclosed under 37 CFR §1.97–1.99.

A variety of simple and inexpensive hand-operated pumps for use as dispensers of liquid have been developed which include means for coupling to a container from which a liquid is to be dispensed under pressure. Such a dispenser typically includes a trigger which is intended to be moved manually to operate a pump piston within a cylinder in a body of the dispenser, usually against the force of a return spring, so that liquid may be pumped from the container and dispensed through an ejection nozzle or outlet orifice.

To meet consumer demands for convenience it has been found highly desirable that the nozzle be adjustable to provide widely varying discharge patterns such as a spray pattern and a stream pattern. It is further preferable that the nozzle assembly not only be adjustable to accommodate a stream or spray mode of operation in a highly reliable fashion, but that it also conveniently engage into an off mode position to contain the liquid in the dispenser to prevent leakage or inadvertent discharge of the liquid and to promote easy storage of the container of liquid by the ultimate consumer.

To minimize cost, the various parts of the prior art dispensers are increasingly made of plastic resins suitable for injection molding. Further, it has been found to be highly desirable that the design of the dispenser be increasingly simplified such that the number of separately molded parts are minimized and so that the assembly of the parts may be mechanized at minimum cost and with maximum economy.

Heretofore, various designs or configurations of nozzle assemblies have been proposed to accommodate the above referenced desirable features, particularly the feature that the nozzle assembly be adjustable to provide widely varying discharge patterns, i.e. a spray pattern and a stream pattern.

Examples of prior dispensers, including adjustable nozzle cap assemblies for selectively dispensing a liquid in spray or stream mode, are disclosed in the following U.S. Patents:

| U.S. Pat. No. | PATENTEE |
|---|---|
| 4,767,060 | Shay et al. |
| 4,706,888 | Dobbs |
| 4,247,048 | Hayes |
| 4,234,128 | Quinn et al. |
| 3,843,030 | Micallef |

In U.S. Pat. No. 4,767,060 there is disclosed a nozzle assembly which is capable of selectively dispensing a liquid product as a foam or a spray by means of a selectively movable member to establish a swirl chamber located in between and in liquid communication with a passageway and a nozzle outlet orifice. Such member can be moved forward into the nozzle cap where it offers no interference with the vortical liquid sheet to effect a spray mode of delivery. The member can be moved rearwardly to a point where the swirl chamber interferes with the vortical sheet to produce a stream pattern. Gas passageways are provided in this structure to achieve aeration of the turbulent fluid and the resultant dispensing of the liquid as a foam.

In U.S. Pat. No. 4,706,888 there is disclosed a nozzle assembly capable of being opened and closed in selective rotative positions of a nozzle cap of the assembly with respect to two discreet passageways formed between a discharge conduit and a discharge orifice to provide an alternating off, stream and spray position for a liquid dispenser. Such multiple passages in a cylinder and the nozzle cap cooperate to move in and out of alignment and communication thus providing the spray and stream mode of operations depending upon alignment and registry of the various described passages and grooves. U.S. Pat. No. 4,706,888 alleges the following drawbacks in the devices disclosed in U.S. Pat. Nos. 3,843,030 and 4,234,128:

> "For example, U.S. Pat. No. 3,843,030 has its nozzle cap containing an off-centered discharge orifice which must be shifted upon cap rotation between alignment with the spin chamber at the end of an internal probe for producing a spray, and a channel on the probe for producing a stream. The off center location of the discharge orifice not only presents problems for the consumer in properly targeting the discharge, but gives rise to a shearing action during cap rotation in that the inner edge of the discharge orifice must traverse the plug surface containing the spin chamber and associated tangentials which could cause abrasions or snags between the rotating parts resulting in undue wear and leakage . . . The nozzle assembly of U.S. Pat. No. 4,234,128 like—wise requires the spin chamber and associated tangential grooves to be formed on the underside of the cap end wall, and passages and slots on an internal plug arranged to produce a stream or spray discharge or shut-off. Thus, some of the details for the dispense function are on the cap end wall and some others are on the plug confronting this end wall, such that a shearing action results between these details as they pass one another upon cap rotation. Due to such abrasive and interrupted engagement between rotating parts, scoring, snags and/or undue wear occurs with consequent leakage."

With respect to U.S. Pat. No. 3,843,030 it is observed that the tubular extension described therein includes a free end having a staggered recess for cooperation with the cap in producing spray and stream modes of operation. In U.S. Pat. No. 4,247,048 there is disclosed a two-piece nozzle assembly which features a tubular member having a circular, planar face at its terminal end with a recess in the planar face. When a cap is rotatably mounted to the tubular member it has an end wall with a planar inside surface which will form an interface with the circular planar face of the tubular member. The dispensing orifice of the cap is radially displaced from the center axis of the cap which is registerable when properly aligned with the recess of the planar face.

SUMMARY OF THE INVENTION

The adjustable nozzle assembly comprises two parts, suitable for injection molding, namely, a nozzle cap and a nose bushing each of which are integral units designed to cooperate in a simplistic, economical and efficient manner. The rotatable nozzle cap contains an internally threaded flange skirt such that the nozzle cap can be screwed upon an externally threaded portion of the nose bushing. Inside the cap, forwardly of the threads, the flange skirt is stepped to an inner wall surface. An orifice extends through the cap from the inner wall surface to a front face of the cap. The inner wall surface is at least partially frusto-conical.

The nose bushing has a nose bushing face disc at its forward end having an outer annular periphery and at least a partially frusto-conical front surface. The outer periphery has two angular, spin-causing grooves therein to allow passage of liquid from axial and radial passageways in the nose bushing to the back of the nose bushing face disc. When the nozzle cap is fully screwed upon the externally threaded portion of the nose bushing, the front surface of the nose bushing face disc is in flush contact with the inner wall surface of the nozzle cap to provide an off mode position for the adjustable nozzle assembly to contain liquid within the dispenser. At the same time, the outer annular periphery of the face disc sealing engages an annular wall surface of the stepped portion of the cap.

As the rotatable nozzle cap is unthreaded from the externally threaded portion of the nose bushing, the frusto-conical seating surface of the nose bushing face disc is unseated from the frusto-conical inner wall surface of the nozzle cap with the outer annular periphery still sealing engaging the annular wall surface. This unseated position of the cap defines a swirl chamber between the front seating surface of the nozzle bushing face disc and the inner wall surface of the nozzle cap. Liquid then passes from the axial and radial passageways to and through the angular grooves in the annular outer periphery of the nose bushing face disc into the swirl chamber in a circular or spinning motion and discharges through the centrally located discharge orifice in the nozzle cap in a conical spray pattern.

When the nozzle cap is further unthreaded from the externally threaded portion of the nose bushing, the outer annular periphery of the nose bushing face disc is opposite a radially outwardly disposed surface such that liquid can now pass around the outer periphery and is not channeled solely through the angular grooves so that the liquid enters the swirl chamber radially inwardly as opposed to angular inwardly in a swirl. As a result, liquid exits the orifice in a stream or jet pattern.

Additional features and advantages of the present invention will become apparent to those skilled in the art from the following description and the accompanying figures illustrating the preferred embodiment of the invention, the same being the present best mode for carrying out the invention.

DESCRIPTION OF THE PREFERRED EMBODIMENT

Figure 1:
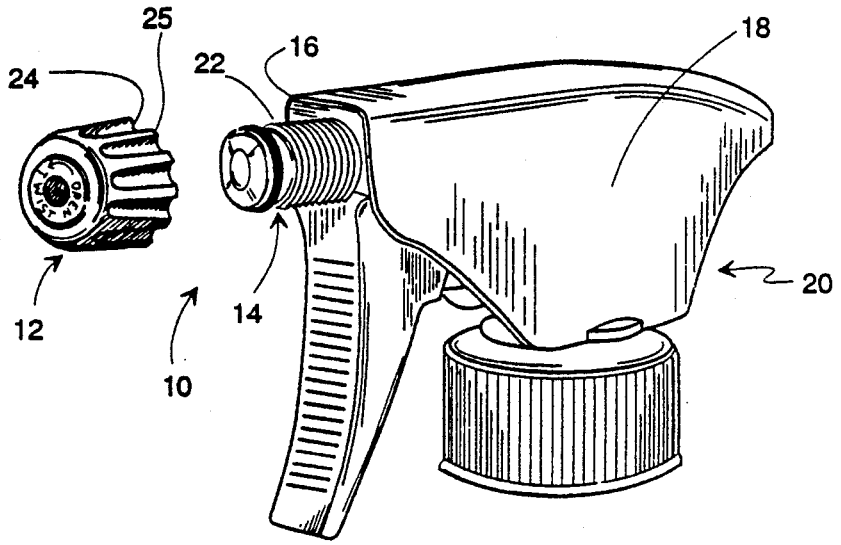
FIG. 1 is a perspective view of an adjustable nozzle assembly constructed according to the teachings of the present invention and shows a nozzle cap unthreadedly detached from a nose bushing which is mounted to the body of a trigger sprayer.
Figure 2:
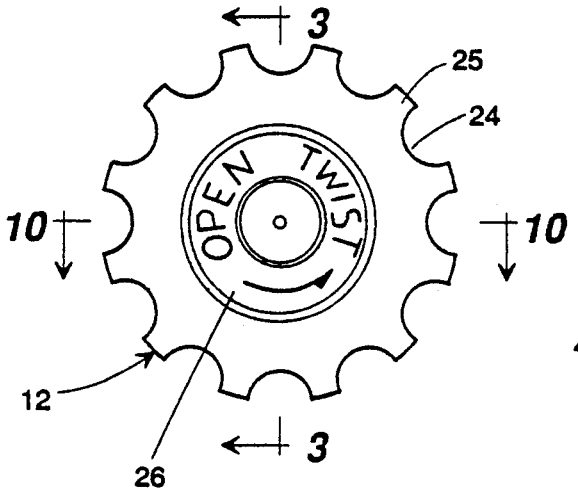
FIG. 2 is a front view of the removed nozzle cap shown in FIG. 1 and shows an alternating rib and groove pattern on the exterior of the nozzle cap for facilitating engagement of the nozzle cap.

With reference to FIG. 1, the adjustable nozzle assembly 10 comprises two integral parts, namely a nozzle cap 12 and a nose bushing 14. The nose bushing 14 is adapted to be mounted to the front end 16 of the body 18 of a trigger sprayer 20 which is mounted on a container of liquid.

As observed in U.S. Pat. No. 4,247,048, a nozzle cap and a nose bushing preferably are made of dissimilar thermo-plastic materials such as polypropylene, polyethylene, polyethylene terephthalate, nylon, or ABS Plastic. In this way, the cap and nose bushing are of dissimilar materials with one material being harder than the other to provide high fidelity liquid seals as the harder material will "seat" into the softer material.

The nozzle cap 12 and nose bushing 14 of the nozzle assembly 10 are each integral pieces which may be fabricated of different materials by conventional injection molding techniques known to those skilled in the art.

Referring to the drawings in greater detail, there is illustrated in FIG. 1, the nozzle cap 12 disengaged from an externally threaded portion 22 of the nose bushing 14 which is mounted to the trigger sprayer 20.

As shown in FIGS. and 2, the nozzle cap 12 has alternating, axially extending, grooves 24 and ribs 25 which facilitate finger and thumb engagement with the cap 12 for rotating same. A front face 26 of the cap 12 has indicia "OPEN TWIST" plus an arrow thereon.

Figure 3:
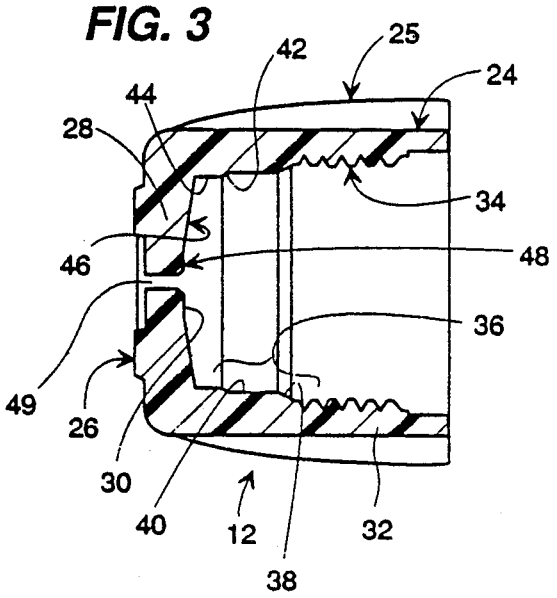
FIG. 3 is a vertical sectional view, is taken along line 3—3 of FIG. 2 and shows a flange skirt of the nozzle cap having a stepped inner surface forwardly of threads inside the flange skirt.
Figure 4:
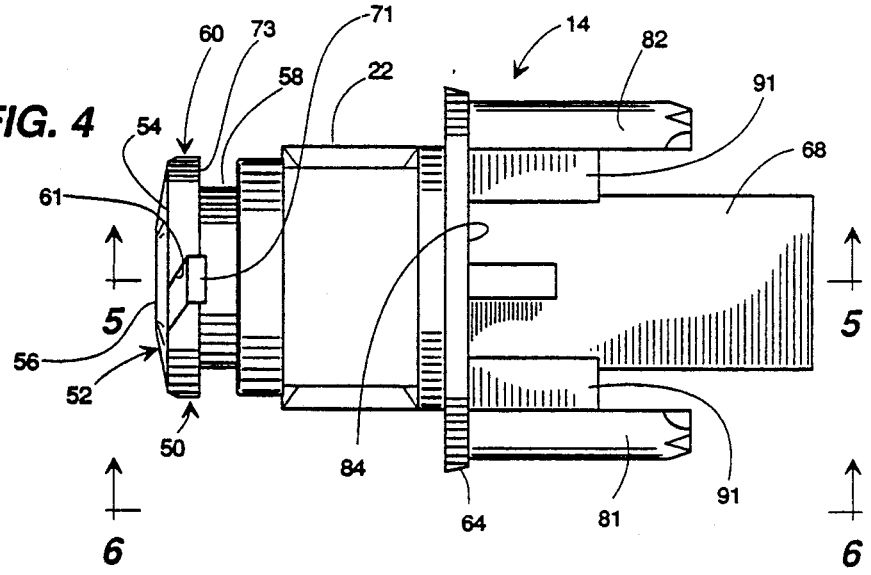
FIG. 4 is a top view of the nose bushing and shows one angular groove in the outer annular periphery of a face disc of the bushing.

As shown in FIG. 3, the nozzle cap 12 includes a front wall 28 disposed between the front face 26 and an inner wall surface 30 and a rearwardly extending sleeve or flange skirt 32. The rear portion of the flange skirt 32 has internal threads 34 adapted to engage the threaded portion 22 of the nose bushing 14. Forwardly of the threads 34, inside the skirt flange 32 of the cap 12 is a stepped formation 36 including a first frusto-conical surface 38, a first annular surface 40, a second frusto-conical surface 42, and a second annular surface 44, extending to the inner wall surface 30 which is slightly frusto-conical at 46 inwardly to a flat radially extending surface 48.

The front wall 28 has an outlet orifice 49 extending therethrough in the center thereof between the inner wall surface 30 and the front face 26.

FIGS. 4–9, are views of the nose bushing 14 and show various portions thereof. The nose bushing 14 includes a face disc 50 having a front face 52 which is slightly frusto-conical at 54 and flat at 56 in the center thereof. The front face 52 is configured and sized to seat against the inner wall surface 30 of the nozzle cap (FIG. 3). The face disc 50 is separated from the threaded portion 22 by an annular slot 58 and has an outer annular periphery 60. The annular periphery 60 has two angularly extending diametrically opposed grooves 61, 62 (FIG. 5) therein for directing liquid flowing therethrough in a swirl pattern between the front face 52 and the inner wall surface 30. The grooves 61–62 are tangential to a cylindrical envelope passing through the grooves 61, 62 and traverse or skew to the elongate axis of the nose bushing 14.

The portions of the nose bushing 14 are integral and at the rear end of the threaded portion 22 is a mid-bushing base 64 which is received against the front end 16 of the body 18 of the trigger.

Figure 5:
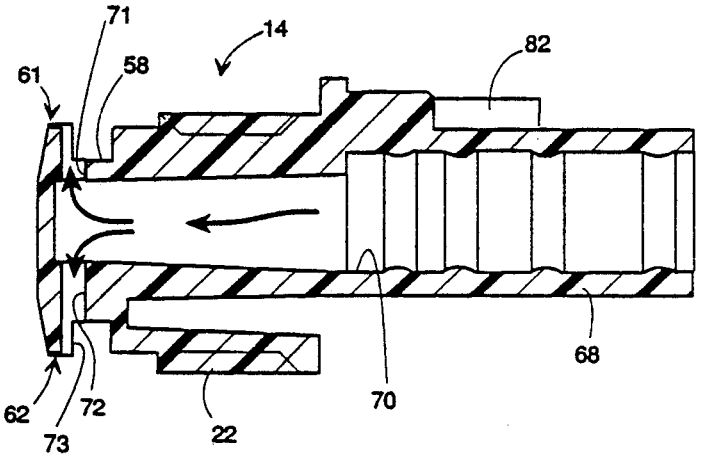
FIG. 5 is a vertical sectional view of the nose bushing, is taken along line 5—5 in FIG. 4 and shows an axial central passageway in the bushing and two radial passageways through the bushing through which liquid passes.
Figure 6:
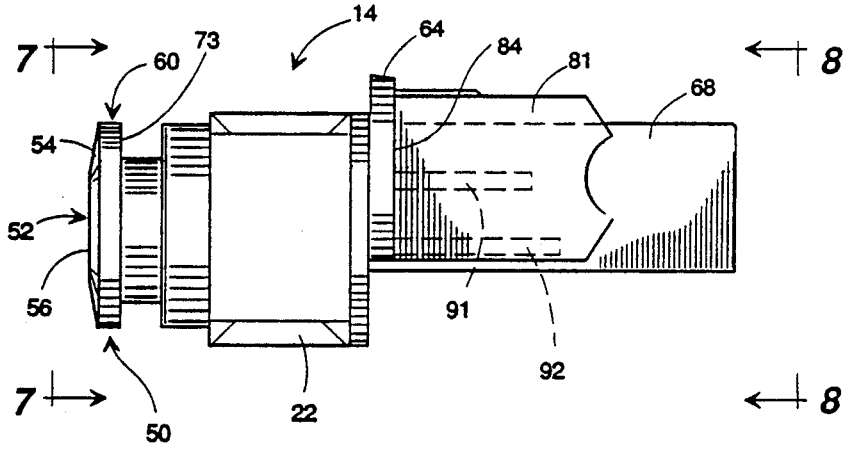
FIG. 6 is a side elevational view of the nose bushing and is taken along line 6—6 of FIG. 4.
Figure 7:
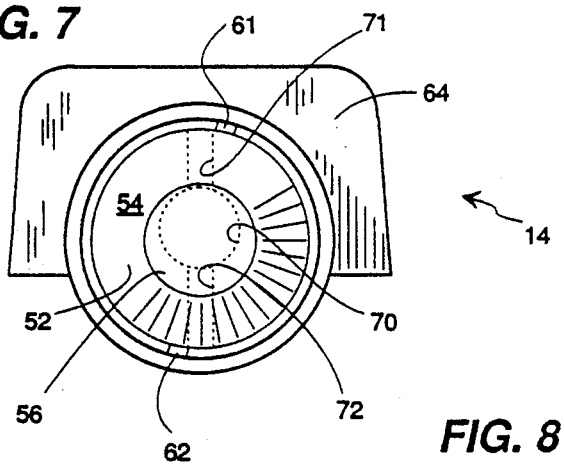
FIG. 7 is a front elevational view of the integral nose bushing, is taken along line 7—7 of FIG. 6 and shows an angular groove in the outer annular periphery of the nose bushing face disc.
Figure 8:
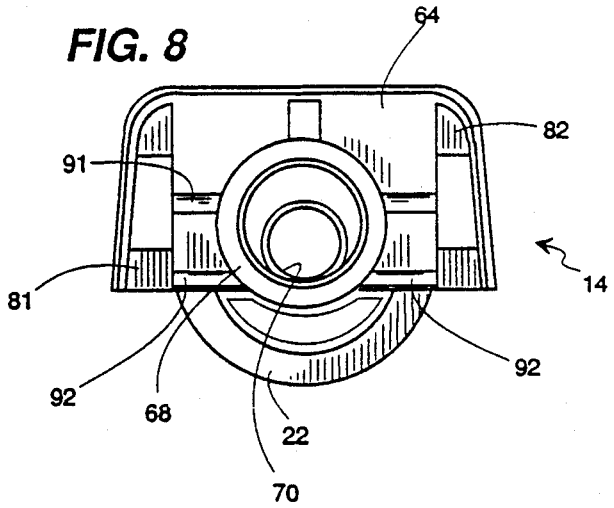
FIG. 8 is a rear elevational view of the nose bushing and is taken along line 8—8 of FIG. 6.
Figure 9:
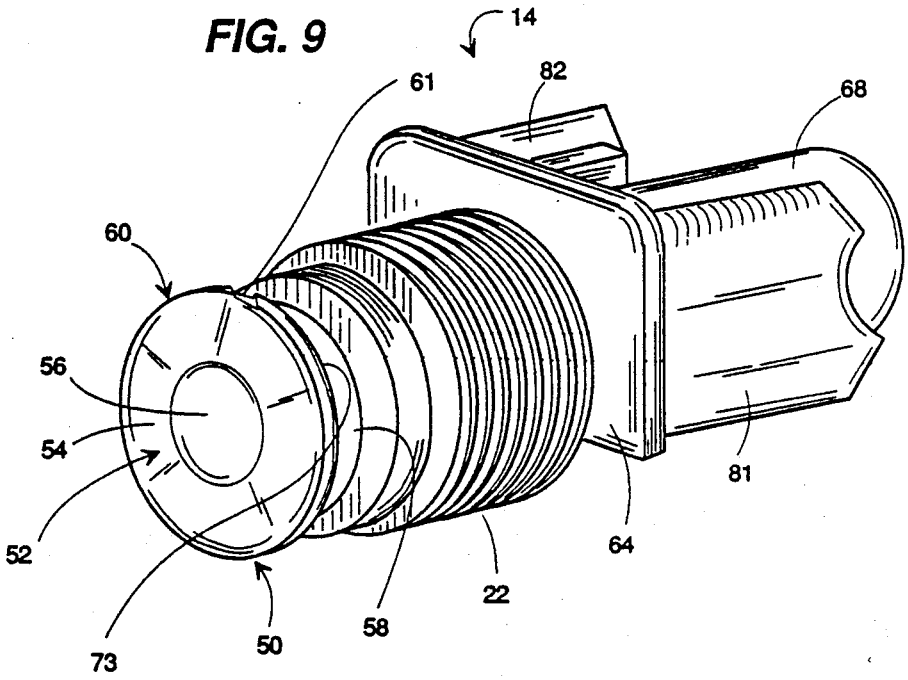
FIG. 9 is a front and side perspective view of the nose bushing and shows the front seating surface of the nose bushing face disc, an externally threaded portion forward of a mid-bushing base, and rearwardly extending mounting flanges.

Extending rearwardly from the base 64 is a tubular body portion 68 having an axial passageway 70 extending through to base 64 and the threaded portion 22 to the back of the nose disc 50 where two radial passageways 71, and 72 extend radially outwardly to the annular slot 58 and through a back side 73 of the nose disc 50 to the slots 61 and 62 as shown in FIG. 5.

The tubular body portion 68 of the nose bushing 14 is coupled to a liquid supply tube or conduit in a conventional manner.

In the embodiment illustrated in FIGS. 4 through 9, the nose bushing includes spaced apart; axially extending flanges 81 and 82 which extend rearwardly from rear wall face 84 of the mid-bushing base 64. Extending perpendicularly inwardly from the rearwardly extending flanges 81 and 82 are two pair of mounting shelves 91, 92.

The face disc 50 has rounded annular corners at the front and rear edges of its annular periphery 60 to facilitate movement of the nozzle cap 12 on the outer annular periphery 60.

Figure 10:
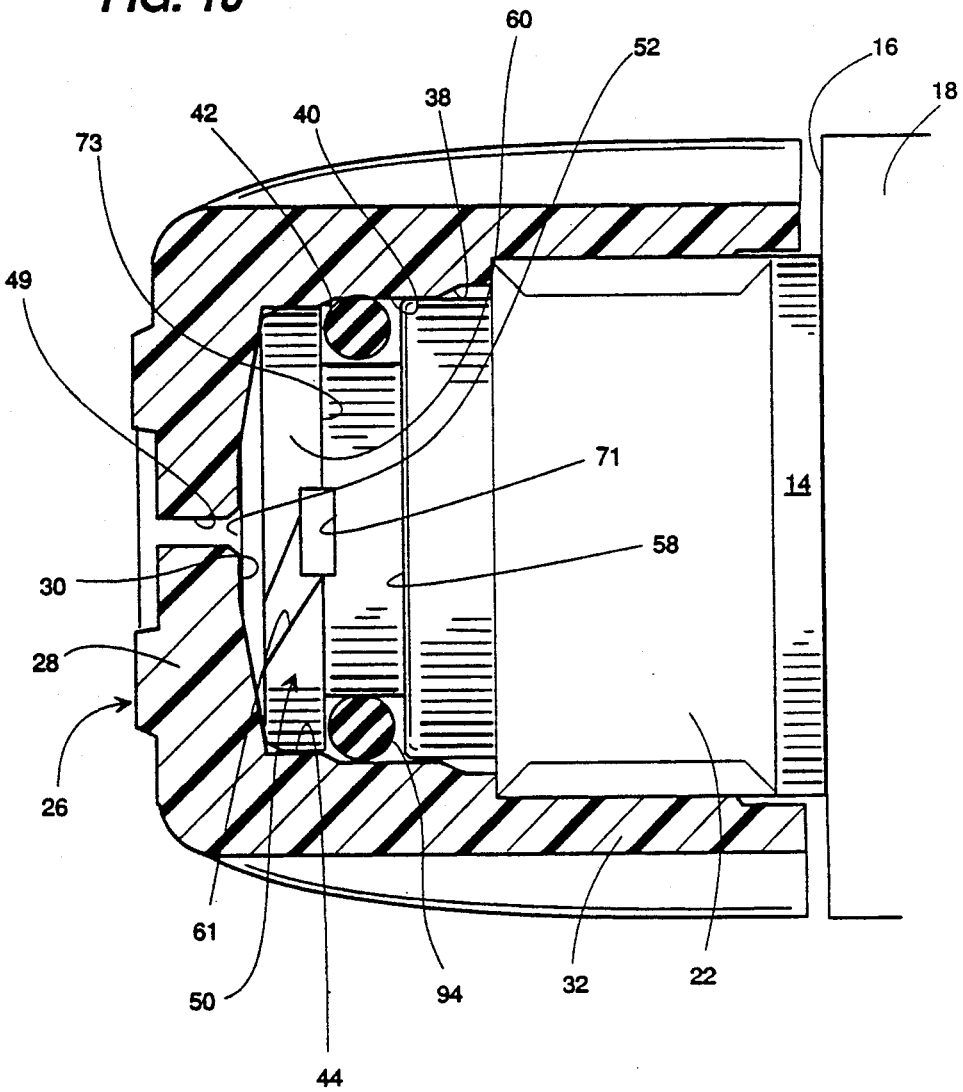
FIG. 10 is a sectional view of the nozzle cap fully threaded onto the nose bushing and a fragmentary top plan view of the front end of the nose bushing, is taken along line 10—10 of FIG. 2, and shows the front seating surface of the nose bushing face disc fully seated against an inner wall surface in the nozzle cap to provide an off mode position for the containment of a liquid.
Figure 11:
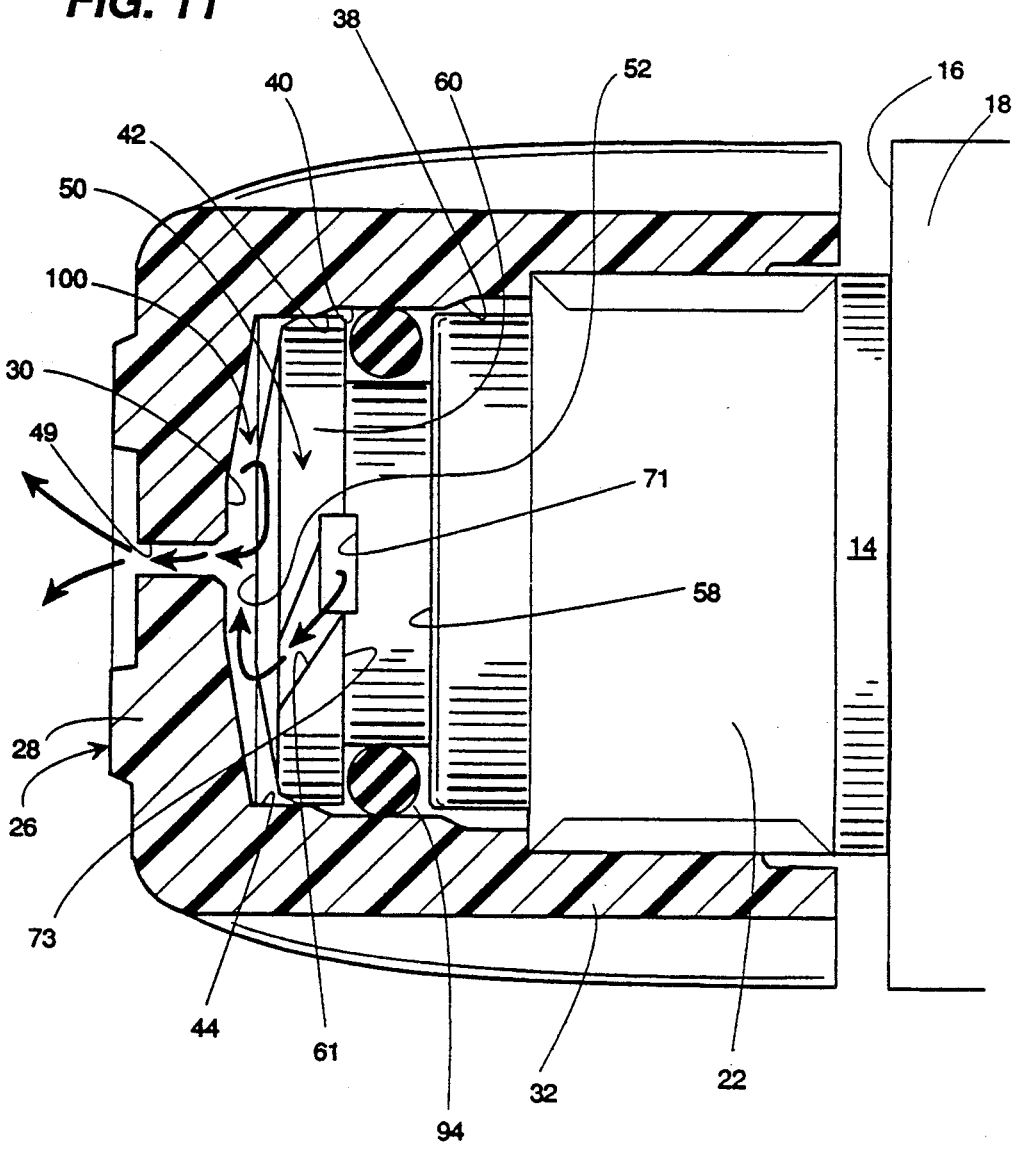
FIG. 11 is a sectional view, similar to FIG. 10, of the nozzle cap, but showing the nozzle cap partially unthreaded from the nose bushing where the front seating surface of the nose bushing face disc is unseated from the inner wall surface of the nozzle cap with the outer annular periphery of the disc still sealingly engaging an annular wall surface of the stepped surface of the flange skirt to define a swirl chamber between the inner wall surface and the face disc and whereby liquid is channeled through the angular grooves in the outer annular periphery of the face disc into the swirl chamber to provide a spray mode position of the adjustable nozzle assembly where liquid is discharged in a generally conical spray pattern.
Figure 12:
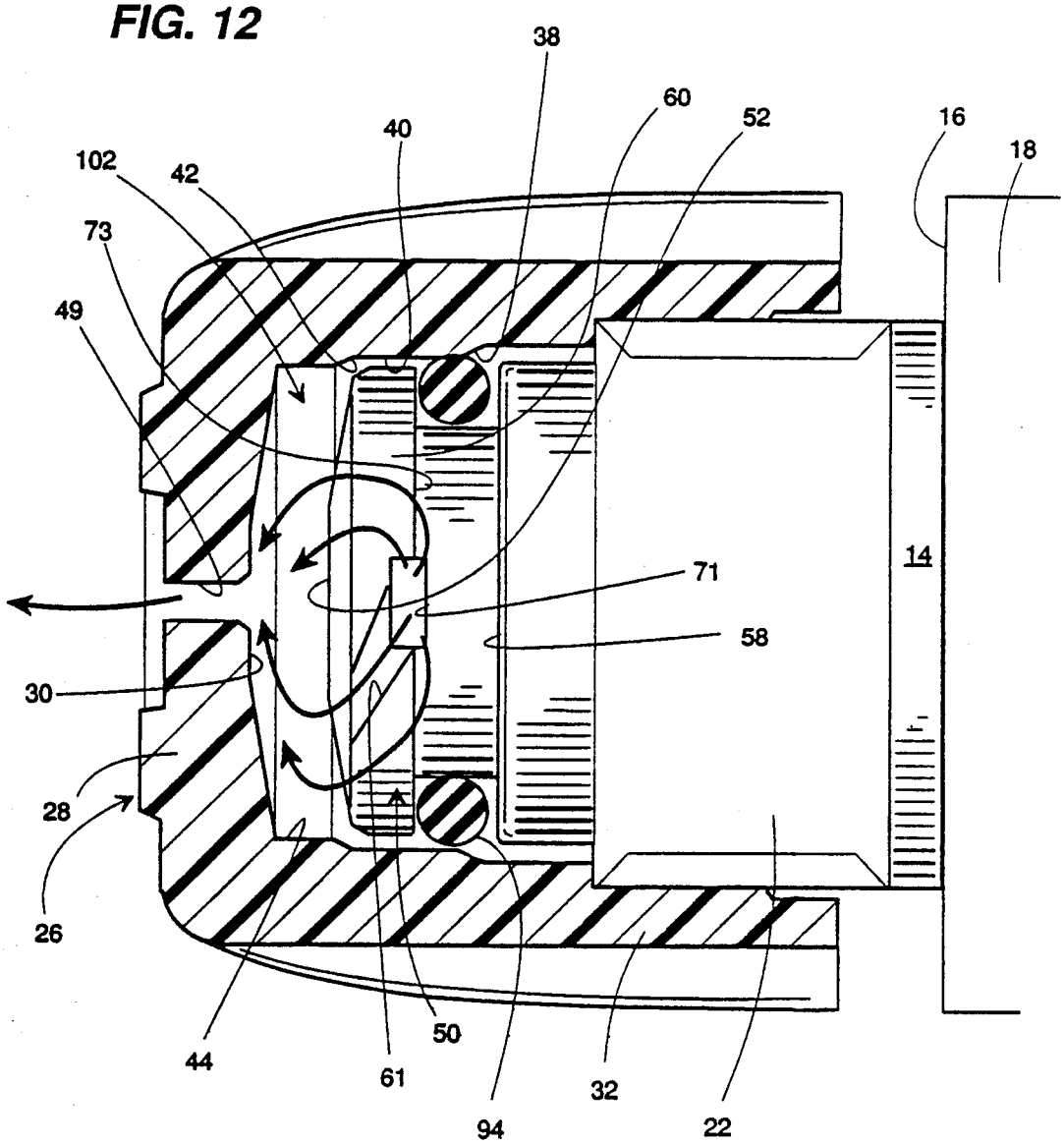
FIG. 12 is a sectional view, similar to FIG. 10, of the nozzle cap, but showing the nozzle cap further unthreaded from the nose bushing to space the inner wall surface of the cap further from the face disc to form a larger chamber and to disengage the outer annular periphery from the annular wall surface of the stepped surface to allow liquid to flow over the outer annular periphery of the face disc without any specified direction into the larger chamber to provide a stream or jet position wherein liquid is discharged in a stream or jet pattern.

In FIGS. 10 through 12 there is illustrated, respectively, the off mode, spray mode, and stream mode positions of the adjustable nozzle assembly 10. In all such modes, a rubber O-ring 94 is located in the annular slot 58 between the face disc 50 and the threaded portion 22 and sealingly engages the first annular surface 40.

More particularly, in FIG. 10 there is shown the off mode position of the adjustable nozzle assembly 10. In this mode, the nozzle cap 12 is screwed upon the externally threaded portion 22 of the nose bushing 14. In this off mode, the outer periphery 60 of the nose bushing face disc 50 is in flush contact with the second annular surface 44 in the nozzle cap flange skirt 32. Also, the front face 52 is in flush sealing contact with the inner wall surface 30 of the nozzle cap 12.

The spray mode position of the adjustable nozzle, assembly 10 is illustrated in FIG. 11. In FIG. 11, the rotatable nozzle cap 12 has been rotated outwardly off the threaded portion 22 of the nose bushing 14 a sufficient distance to a second position where the inner wall surface 30 of the nozzle cap 12 is moved forward from the front seating surface 52 of the nose bushing face disc 50 to an unseated position. This unseated position defines a swirl chamber 100 between the front seating surface 52 of the nozzle bushing face disc 50 and the inner wall surface 30 of the nozzle cap 12 and permits liquid from the axial passageway 70 (FIG. 5) and the radial passageways 71 and 72 (FIG. 5) to flow to and through the angular spin causing groves 61 and 62 (FIG. 7) into the swirl chamber 100 in a circular or spinning motion for discharge through the discharge orifice 49 in the front wall 28 of the nozzle cap 12 in a conical spray pattern. The swirl chamber 100 is defined between the second annular surface 44, the front seating surface 52 of the face disc 50 and the inner wall surface 30 of the nozzle cap 12.

In this respect, note that the outer periphery 60 of the face disc 50 is still in sealing engagement with the annular surface 44 whereby liquid flow is constrained to flow, or is channeled through the angular groves 61 and 62 (FIG. 7) to create a swirl flow in the swirl chamber 100. The conical spray mode of operation of the adjustable nozzle assembly 10 is characterized by the unseating of the front seating surface 52 from the inner wall surface 30, but with the annular periphery 60 of the nose bushing face disc 50 remaining in flush contact with the annular surface 44 in the nozzle cap flange skirt 32, so as to not permit liquid to move over or around the nose bushing face disc 50 into the swirl chamber 100 but only to only permit liquid to flow through the angular spin-causing grooves 61, 62 into the swirl chamber 100 in a circular or spinning motion for discharge out of the nozzle cap discharge orifice 49 in a conical spray pattern.

In FIG. 12 there is illustrated a stream or jet mode position of the adjustable nozzle assembly 10 where the nozzle cap 12 is unthreaded further outwardly from the nose bushing 514 to create a larger chamber 102, the annular periphery 60 of the nose bushing face disc 50 is located opposite and spaced from the larger diameter annular surface 40 in the nozzle cap flange skirt 32. The discharge of liquid in this mode will be changed to a stream or jet pattern due to the fact that liquid from the radial passageways 71 and 72 (FIG. 5) can now pass over and around the annular periphery 60 of the nose bushing face disc 50 and is not constrained to flow through the angular spin-causing grooves 61, 62 for entry into the larger chamber 102 for discharge out of the nozzle cap discharge orifice 49. As a result, the liquid flow is not directed or channeled and the non-specific liquid flow is basically radially inwardly to the discharge orifice 49 and not in a swirl. This results in a stream discharged from the outlet orifice 49.

It is believed that the adjustable nozzle assembly 10 of the present invention and its numerous attendant advantages will be fully understood from the foregoing description, and that changes may be made in form, construction, and arrangement of the several parts thereof without departing from the spirit or scope of the invention, or sacrificing any of the attended advantages. The structures herein disclosed are preferred embodiments for the purpose of illustrating the invention. Accordingly, the scope of the invention is only to be limited as necessitated by the accompanying claims.

We claim:

1. An adjustable nozzle assembly for a liquid dispenser comprising:

a nozzle cap having a discharge orifice located in a front face of a front wall thereof and a nozzle cap flange skirt extending rearwardly from said front wall, said nozzle cap flange skirt having threads for cooperating with a threaded portion of a nose bushing for selectively positioning the nozzle cap relative to the nose bushing, said flange skirt also having an inner stepped surface defined by two annular surfaces forward of said threads, the smaller diameter of the two annular surfaces being positioned to extend rearwardly from an inner wall surface of said nozzle cap and the larger diameter of the two annular surfaces being located just forward of said threads;

a nose bushing comprising a body having an axially extending hollow passage extending into said body from a rear end thereof to a first inner wall and having two radial passageways extending radially outwardly to an annular slot formed in said body, said body including a threaded portion and a front face disc separated by said annular slot, and said face disc having a front face and an annular outer periphery with two angular, diametrically opposed, grooves therein;

said nozzle cap being threadedly received on said nose bushing and selectively movable relative to said nose bushing to three positions including (a) an off mode position wherein said front face of said nose bushing face disc is in flush contact with said inner wall surface of said nozzle cap and with said first and smaller diameter annular surface in said nozzle cap flange skirt in flush sealing contact with said outer periphery of said face disc to prevent communication of liquid from the angular grooves to the discharge orifice, (b) a spray mode position wherein said front face of said nose bushing face disc is unseated from said inner wall surface of said nozzle cap, said unseated position defining a swirl chamber within said nozzle cap between said front face of said nose bushing face disc and said inner wall surface of said nozzle cap but with said outer annular periphery of said nose bushing face disc still in flush, sealing contact with said smaller diameter annular surface in said nozzle cap flange skirt so that liquid flowing radially outwardly from said radial passageways into said annular slot is channeled to move only through said angular grooves into said swirl chamber in a circular or spinning motion for discharge out of the nozzle cap discharge orifice in a conical spray pattern, and (c) a stream mode position wherein said outer annular periphery of said nose bushing face disc is unseated from said smaller diameter annular surface in said nozzle cap, such that said outer annular periphery of said nose bushing face disc is spaced from said larger diameter annular surface to permit liquid from said radial passageways to flow over said outer annular periphery in a non-directed manner to said discharge orifice and out of said discharge orifice in a stream pattern.

2. The adjustable nozzle assembly for a liquid dispenser as defined in claim 1 wherein said nozzle cap has alternating, axially-extending, grooves and ribs on the outer surface of the nozzle cap flange skirt for facilitating gripping and rotation of said nozzle cap.

3. The adjustable nozzle assembly for a liquid dispenser as defined in claim 1 wherein said front seating surface of said nose bushing face disc and said inner wall surface of said nozzle cap face wall are partially planar and partially frusto-conical.

4. The adjustable nozzle assembly for a liquid dispenser as defined in claim 1 wherein said nozzle cap and said nose bushing are made of different thermoplastic material.

5. The adjustable nozzle assembly for a liquid dispenser as defined in claim wherein said discharge orifice is centrally located relative to said nozzle cap front face.

6. An adjustable nozzle assembly comprising a nose bushing which is adapted to be mounted to a dispensing end of a liquid dispenser and which has an outer threaded portion and a cup shaped nozzle cap which has a front wall with an outlet orifice therein and a rearwardly extending generally cylindrical sleeve, said sleeve having internal threads therein for threadably mounting said cap on said threaded portion of said bushing, said nose bushing including a front face disc having a front face, an outer annular periphery and two circumferentially spaced apart angular grooves in said annular periphery, means for mounting said bushing to said liquid dispensing device, and passage means in said bushing adapted to communicate at one end with liquid outlet means in the liquid dispensing device and at another end with said angular grooves;

and said nozzle cap having specially contoured surfaces within said sleeve and an inner wall surface of said front wall within said cap constructed and configured to cooperate with and mate with portions of said face disc;

said nozzle cap being rotatable and axially moveable relative to said nose bushing between three positions, the first position being defined by the nozzle cap being threaded onto said nose bushing to a point where portions of said front face and said annular periphery of said face disc mate with portions of said specially configured surfaces to close off and seal said outlet orifice, the second position being defined by the nozzle cap being partially unthreaded from said nose bushing to unseat said front face of said face disc from said inner wall surface but with said annular periphery still in sealing engagement with a portion of said specially contoured surface within said sleeve so that a swirl chamber is established between said inner wall surface and said face disc and so that liquid is channelled through said two angular grooves to travel in a swirl in said swirl chamber and exit said outlet orifice in a conical spray pattern, and said third position being defined by a further partially unthreaded position of said nozzle cap where said face disc is completely unseated from said specially contoured surface within said nozzle cap so that liquid can now flow over said outer annular periphery of said face disc and radially inwardly to and out of said outlet orifice in a stream pattern.

7. The adjustable nozzle assembly of claim 6 wherein said inner wall surface of said nozzle cap is partially frusto-conical and partially planar and said front face of said face disc is partially frusto-conical and partly planar to mate with and sealingly engage with said inner wall surface.

8. The adjustable nozzle assembly of claim 6 wherein said specially contoured surface within said nozzle cap includes an annular surface which sealingly engages with said outer annular periphery of said face disc and a larger diameter surface which does not engage said outer annular periphery of said face disc.

9. The adjustable nozzle assembly of claim 6 wherein said passage means within said nose bushing includes an axial passageway extending forwardly from a rear end of said nose bushing to a back side of said face disc and two opposed radial passageways which extend radially outwardly from said axial passageway to respective ones of said angular groves.

10. The adjustable nozzle assembly of claim 9 wherein said nose bushing includes an annular slot in the area of said radial passageways between said face disc and said threaded portion of said nose bushing.

11. The adjustable nozzle assembly of claim 10 including an elastic O-ring received in said annular slot and adapted to engage and seal against a portion of said specially contoured surface within said nozzle cap.

12. The adjustable nozzle assembly of claim 11 wherein said radial passageways extend to said annular slot and through a portion of the back side of said face disc.

13. The adjustable nozzle assembly of claim 6 wherein said nose bushing includes a mid-bushing base adapted to seal against the front end of the body of a trigger sprayer.

14. The adjustable nozzle assembly of claim 13 including mounting structure which extends rearwardly from said midbushing base for being received within the body of the trigger sprayer for mounting the nose bushing to the trigger sprayer.

* * * * *